United States Patent [19]

Schwarzkopf

[11] 4,124,159

[45] Nov. 7, 1978

[54] CONTAINER CONSTRUCTION

[75] Inventor: Robert W. Schwarzkopf, Cherry Hill, N.J.

[73] Assignee: Weyerhaeuser Company, Tacoma, Wash.

[21] Appl. No.: 866,720

[22] Filed: Jan. 3, 1978

[51] Int. Cl.[2] ..... B65D 5/72

[52] U.S. Cl. ..... 229/17 R; 229/17 G; 93/94 PS; D9/240

[58] Field of Search ..... 229/7 R, 17 R, 17 G; 93/94 PS; D9/240

[56] References Cited

U.S. PATENT DOCUMENTS

| | | | |
|---|---|---|---|
| 3,203,614 | 8/1965 | Larson et al. | 229/17 G |
| 3,365,111 | 1/1968 | McNair, Jr. et al. | 229/17 G |
| 3,495,507 | 2/1970 | Haas et al. | 229/17 G X |
| 3,654,842 | 4/1972 | Schwenk | 93/94 PS |
| 3,743,164 | 7/1973 | Clark | 229/17 R |
| 3,869,078 | 3/1975 | Braun | 229/17 R |
| 3,892,347 | 7/1975 | Egleston | 229/17 R |
| 4,078,715 | 3/1978 | Larsson et al. | 229/17 R |

*Primary Examiner*—Davis T. Moorhead

*Attorney, Agent, or Firm*—Allegretti, Newitt, Witcoff & McAndrews

[57] ABSTRACT

A container of paperboard construction of the type having a coating of thermoplastic material that acts as an adhesive to hold the container together. The container includes a tubular body section, a top closure, and a bottom closure. The tubular body includes first, second third and fourth contiguous side walls, each of which has an inner surface and an outer surface. The sealing flap is contiguous with the fourth side wall and is sealably secured to the outer surface of the first side wall for forming the tubular body. The top closure includes a pair of opposed roof panels, a pair of triangular end panels which are in-folded between the roof panels, two pairs of triangular fold-back panels, each pair of the fold-back panels being unitary with respect to one of the roof panels, an outer rib panel connected to each of the roof panels, and a pair of inner rib panels being connected to each of the fold-back panels. A pouring spout is stored in a collapsed condition within the container and is defined by one of the triangular end panels, an adjacent pair of the fold-back panels, the inner rib panels, portions of the roof panels, and the outer rib panels. Each of the roof panels, the triangular end panels, the triangular fold-back panels, the outer rib panels, and the inner rib panels has an inner surface and an outer surface. The sealing flap is adhesively secured to the outer surface of a portion of a triangular end panel, a fold-back panel, and an inner rib panel, which are located above the first panel where said sealing flap is adhesively secured.

4 Claims, 14 Drawing Figures

CONTAINER CONSTRUCTION

BACKGROUND OF THE INVENTION

Field of the Invention and Description of the Prior Art

This invention relates to an improved thermoplastic coated paperboard container of the type having a gabled top and pouring spout for a liquid contained therein, provided in the top closure thereof, and the invention particularly relates to such a liquid storage container wherein the top closure is formed or is formable into a substantially flattened or partially flattened condition.

Paperboard cartons having a thermoplastic coating thereon for containing liquids have been widely used for many years. Probably the most widely used of these cartons is the "gable top" type of container which includes a unitarily formed pouring spout in the top closure thereof. Examples of thermoplastic coated paperboard containers of the "gable top" type are:

Arslanian U.S. Pat. No. 3,232,516
Arslanian U.S. Pat. No. 3,239,126
Braun U.S. Pat. No. 3,498,524
Crawford U.S. Pat. No. 3,116,002
Crawford U.S. Pat. No. 3,185,376
Crawford U.S. Pat. No. 3,291,369
Crawford U.S. Pat. No. 3,334,799
Crawford U.S. Pat. No. 3,471,076
Egleston U.S. Pat. No. 3,120,335
Egleston U.S. Pat. No. 3,270,940
Egleston U.S. Pat. No. 3,406,892
Egleston U.S. Pat. No. 3,474,951
Huang U.S. Pat. No. 3,319,868
Huang U.S. Reissue No. 26,305
McNair U.S. Pat. No. 3,365,111
Miller U.S. Pat. No. 3,294,310
Miller U.S. Pat. No. 3,412,922
Pike U.S. Pat. No. 3,365,115
Schwenk U.S. Pat. No. 3,654,842
Seiple U.S. Pat. No. 3,120,333
Thomas U.S. Pat. No. 3,185,375

Containers of this type, generally disclosed in the foregoing patents, all of which are the "gable top" type, have a unitarily formed pouring spout stored within the gable top and have been widely used and widely accepted. However, recently efforts have been directed towards folding down the gable top of these containers to provide a flat top end closure. Such flat top end closures are shown, for example, in Egleston Design Pat. No. 235,515, in Braun U.S. Pat. No. 3,869,078, and in Egleston U.S. Pat. No. 3,892,347. The purpose of the flat end closure containers is to provide for easier stacking of the containers, such as in dairy shipping cases and in refrigerated grocery display cases and for reducing the storage and/or shipping volume required for such containers in each size.

One flat top end closure container that has been used generally comprises a top closure which is generally formed in a manner similar to the gable top construction, except that there are dimensional changes so that the top, after sealing, may be folded down into a flattened condition and secured, in one embodiment; in a second embodiment, the container top is slanted, when sealed, and then folded down into a flattened position, when another container is placed thereon.

In the folded down, flat top and slant top containers, and even on occasion in the upright gable top containers, a problem has developed with top leakage occurring because of delamination of the internally located side seam flap. Specifically, in the commercially known smaller cross section containers, that is, the so-called "mini" sizes and in the standard quart sizes, the side seam flap that is secured to the inner surface of the container has a raw edge which is exposed to the interior of the container and is folded in opposite directions. Internal delamination of the paperboard generally occurs in that portion of the side seam flap attached to the triangular end panel, since it is stretched and folded in opposite directions on its fold lines or scores; these fold lines coincide with those which define the attached triangular end panel. Because of the stretching, delamination of the side seam flap also can extend a distance above and below the fold lines. Delamination of the paperboard results in penetration of the enclosed liquid and subsequent leaking and softening of the carton in this area.

Because the larger sizes, namely, the gallon and half gallon sizes, are formed in a different way, the side seam flaps are not specifically susceptible to delamination and top leakage in these sizes.

Although the top leakage problem can occur in the conventional gable top construction, delamination of the side seam flap is much more pronounced when the top is completely or partially folded down as in the flat or slant top configuration. Further, when the top is completely or partially folded down, the delaminated edge of the side seam flap is brought into closer relationship with the upper surface of the milk or other liquid contained within the container. Thus, the flat top and slant top containers formed in this manner are exceptionally susceptible to top leakage problems.

Although this delamination problem can, conceivably, be handled in various ways, it is considered important that the problem be solved in a simple way which involves minimal changes both in the cutting and scoring of the carton blanks and in the formation of the carton blanks into erected containers.

SUMMARY OF THE INVENTION

It is therefore an important object of this invention to provide an improved paperboard container construction of the type having a top end closure, containing a pouring spout, in a collapsed condition, wherein the problem of top leakage is substantially avoided.

It is a particular object of this invention to provide a flat top end closure paperboard container construction for the commercially known "mini" sizes and quart series, wherein the problem of delamination of the side sealing flap is substantially avoided by placing the sealing flap on the exterior side of the container, which results in only minor changes in the manner of manufacturing the container blank and involves substantially no changes in the manner of forming the erected container from the container blank.

It is a further object of this invention to provide an improved flat top end closure for liquid containers wherein the side sealing flap is placed on the exterior of the container body to thereby avoid exposing its raw edge, which, if placed within the container may become delaminated and subject to leaking.

It is still another object of this invention to provide improved gable top, flat top and slant top containers for liquids wherein the construction thereof is characterized by simplicity and economy of construction and effectiveness in use, by substantially avoiding top leakage problems.

The foregoing objects are substantially accomplished by providing a container of paperboard construction of the type having a coating of a thermoplastic material which acts as an adhesive, when heated, to hold the container together, the container structure comprising a tubular body, a top closure for the tubular body, a bottom closure for the tubular body, the tubular body being defined by first, second, third and fourth contiguous side walls, each of the side walls having an inner surface and an outer surface, a sealing flap being contiguous to the fourth side wall and being sealably secured to the outer surface of the first wall for forming the tubular body, the top enclosure including a pair of opposed roof panels, a pair of triangular end panels which are in-folded between the roof panels, two pairs of triangular fold-back panels, each pair of the fold-back panels being unitary with respect to one of the roof panels, an outer rib panel connected to each of the roof panels, a pair of inner rib panels connected to each of the fold-back panels, a pouring spout stored in a collapsed condition within the container and being defined by one of the triangular end panels, an adjacent pair of the fold-back panels and inner rib panels, portions of the roof panels and the outer rib panels, each of the roof panels, the triangular end panels, the triangular fold-back panels, the outer rib panels, and the inner rib panels having an inner surface and an outer surface, the sealing flap being adhesively secured to the outer surface of each end panel, fold-back panel and inner rib panel which is located above the first panel to which the sealing flap is adhesively secured.

BRIEF DESCRIPTION OF THE DRAWINGS

Referring to the accompanying drawings, there is shown representative prior art and several embodiments of the present invention, wherein.

DETAILED DESCRIPTION OF THE PREFERRED EMBODIMENTS

Figure 1:
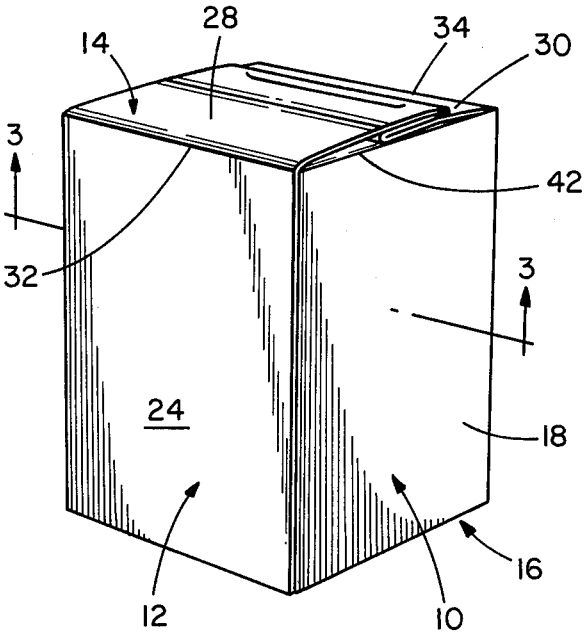
PRIOR ART FIG.1
FIG. 1 is a pictorial view of one embodiment of a prior art flat top end closure liquid container.
Figure 2:
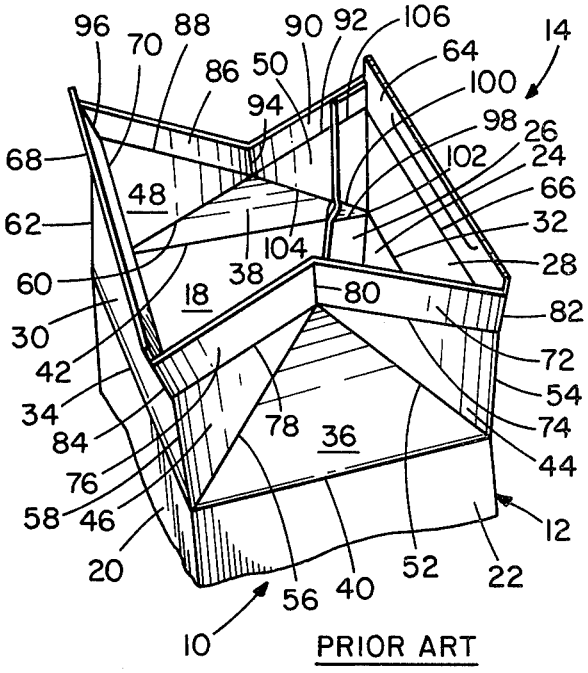
PRIOR ART FIG.2
FIG. 2 is the prior art container illustrated in FIG. 1 with the top closure shown, in pictorial view, when in the open condition.

Referring to the embodiment shown in FIGS. 1–5, a prior art flat top closure container, generally 10, is shown. Referring specifically to FIGS. 1 and 2, the prior art flat top container is of a type that is used for the storage of liquids, particularly milk. The container 10 is generally formed from a single blank which has been cut and scored and which is then formed into an erected condition, as shown in FIGS. 1–5. The paperboard container is generally coated with a thermoplastic material, such as polyethylene, which, when heated, acts as an adhesive to secure the container into fully erected condition with a liquid stored therein. One patent showing a thermoplastic coated paperboard container is Egleston et al U.S. Pat. No. 3,270,940, mentioned previously. Although the prior art container 10 is shown as a "flat top" container, it is to be understood that the invention, to be hereinafter described, is considered an improvement over various of the liquid containers having a pouring spout formed in the top closure, including gable top, flat top and slant top containers; however, the invention does find its most significant advantages in the flat top and slant top type containers for reasons to be hereinafter discussed.

The prior art container 10 generally includes a tubular body section, generally 12, a top closure, generally 14, and a bottom closure, generally 16. As seen best in FIG. 2, the tubular body section 12 includes contiguous side walls 18, 20, 22 and 24. The container 10 includes a sealing flap 26 which is contiguous with the side wall 24.

As seen best in FIG. 2, it is conventional both in the flat top type of container shown in FIGS. 1–5, as well as in gable top liquid containers, of the smaller cross-section size containers, to bond the sealing flap 26 to the inner surface of the side wall section 18 by use of the polyethylene material coated thereon, in order to form the tubular body section 12 of the container 10 into an erected condition.

In the container 10, the flat top closure 14 is formed in substantially the same manner as gable top containers, as disclosed in the prior art, previously mentioned, except that there are dimensional differences so that the top closure 14 in the embodiment 10 may be either secured in a flattened condition, or may be moved to a flattened condition, as by another container resting thereon. The top closure 14, as seen best in FIG. 2, includes a pair of opposed roof panels 28 and 30. The roof panel 28 is contiguous with the side wall 24 along a score line 32. The roof panel 30 is contiguous with the panel 20 along a score line 34.

A pair of triangular end panels 36 and 38 are folded inwardly towards each other below the roof panel 28 and 30. The triangular end panel 36 is contiguous with the side wall 22 and is connected thereto along a score line 40. The triangular end panel 38 is contiguous with the side wall 18 and is connected thereto along a score line 42.

A pair of triangular fold-back panels 44 and 46 are associated with the triangular end panel 36, and triangular fold-back panels 48 and 50 are similarly associated with the end panel 38. The triangular fold-back panel 44 is interconnected to the end panel 36 along a score line 52 and is interconnected to the roof panel 28 along a score line 54. The triangular fold-back panel 46 is interconnected to the end panel 36 along a score line 56 and is interconnected to the roof panel 30 along a score line 58. The fold-back panel 48 is interconnected to the triangular end panel 38 along a score line 60 and is interconnected to the roof panel 30 along a score line 62.

An upper and outer rib panel 64 is interconnected to the roof panel 28 along a score line 66. An opposed upper and outer rib panel 68 is contiguous with and is interconnected to the roof panel 30 along a score line 70. An inner rib panel 72 is contiguous with and is interconnected to the fold-back panel 44 along a score line 74. An adjacent inner rib panel 76 is contiguous with and is interconnected to the fold-back panel 46 along a score line 78. The inner rib panels 72 and 76 are contiguous with and interconnected to each other along a vertical score line 80, the inner rib panel 72 is interconnected to the outer rib panel 64 generally along a score line 82, and the inner rib panel 76 is interconnected to the outer rib 68 along a score line 84.

Similarly, an inner rib panel 86 is contiguous with and is interconnected to the fold-back panel 48 along a score line 88. An adjacent inner rib panel 90 is contiguous with and is interconnected to the fold-back panel 50 along a score line 92. The inner rib panels 86 and 90 are contiguous with and interconnected to each other along a vertical score line 94. The inner rib panel 86 is contiguous with and interconnected to the outer rib panel 68 along a score line 96.

In the prior art container 10, embodied in FIGS. 1–5, the side seam flap 26 is bonded along its outer surface to the inner surfaces of contacting portions of the side wall 18, the triangular end panel 38, the fold-back panel 50, and the inner rib panel 90. The side seam flap 26 includes a horizontal score line 98 which is aligned with the score line 42 between the side wall 18 and the triangular end panel 38. A diagonal score line 100 is positioned thereabove and intersects the score line 98 at an intersection point 102.

The score line 100 is aligned with a score line 104 which joins the fold-in panel 50 to the triangular end panel 38. An upper score line 106 is provided on the side sealing flap 26 and is aligned with the score line 92 which joins the inner rib panel 90 to the fold-back panel 50.

The bottom closure 16 provided on the container 10 may be any of a variety of commercially known liquid container bottoms; suitable bottoms are shown in U.S. Pat. Nos. 3,270,940; 3,120,335; 3,120,333.

In the container 10 of FIGS. 1–5, there has been a leakage problem associated with delamination of the paperboard in the side seam flap 26 in the inside of the top closure, in the area indicated by the reference number 108. This is considered to be due to the folding of portions of the side sealing flap 26, relatively close together, around the end panel 38 and the fold-in panel 50. The delamination portion 108 is illustrated best in FIG. 3.

Figure 4:
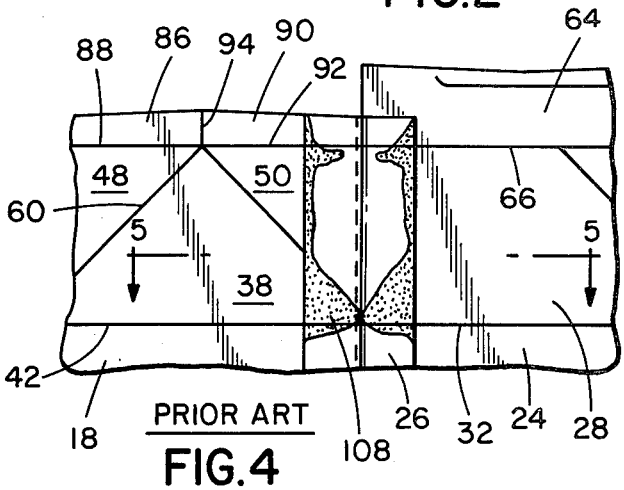
PRIOR ART FIG.4
FIG. 4 is a plan view of a prior art container with the side seam flap torn apart and laid back, illustrating the manner in which wicking and subsequent leakage occurs in the top end closure because of delamination of the side sealing flap in the top closure portion of the container.
Figure 5:
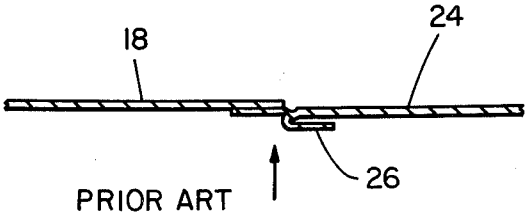
PRIOR ART FIG.5
FIG. 5 is a cross sectional view taken along the line 5—5 of FIG. 4.

In FIGS. 4 and 5, there is schematically illustrated the type of liquid penetration that occurs in the top of a container, particularly a flap top type container, generally in the area of delamination 108. Referring to FIG. 5, there is a cross-sectional view through a container that has been tested to determine susceptibility to top leakage in a container of the type shown in FIGS. 1 and 2. The container has been opened to a flattened condition, after testing, and the side sealing flap 26 has been separated for its entire width along the delamination 108 as shown in FIG. 5.

A flattened view of the delamination area 108 is shown in FIG. 4, as viewed in the direction of the arrow in FIG. 5. In testing, a liquid containing a dye was placed in a container. The shaded area in FIG. 4 illustrates the area that shows the liquid dye penetration. Particularly at the area 108, shown in FIG. 4, it is seen that there is complete penetration, leading to top leakage. It is believed that this delamination problem, found in gable top, and particularly the flat top and slant top containers, of the commercial "mini" and quart sizes, as is known in the art, is caused by forces imparted to the side sealing flap 26 in the area of the score lines 98 and 100, particularly at the delamination area 108 and in the area adjacent thereto.

In the known state of the art, as indicated above, it is conventional to utilize a side sealing flap 26, as shown in FIGS. 1–5, only in the commercially used quart series sizes and in the "mini" series sizes. In the larger size containers, which have a larger transverse cross section, such as the conventional one-half gallon and one gallon containers, the side sealing flap 26 is secured to the adjacent side wall in a different manner and does not encounter the same leakage problem encountered by the container 10 embodied in FIGS. 1–5.

Although the top leakage problem, as described, could be solved in a variety of ways, it is important that the problem be solved simply and economically, without involving significant changes in cutting or scoring the blanks and without involving significant changes in the manner of forming and erecting the container from the blank. My inventive container, generally 150, requires only minimal changes, which are simple and inexpensive, and which substantially avoid the top leakage problem encountered at the delamination section 108 in the flat top, slant top and gable top containers of the type generally illustrated in FIGS. 1–5.

Figure 6:
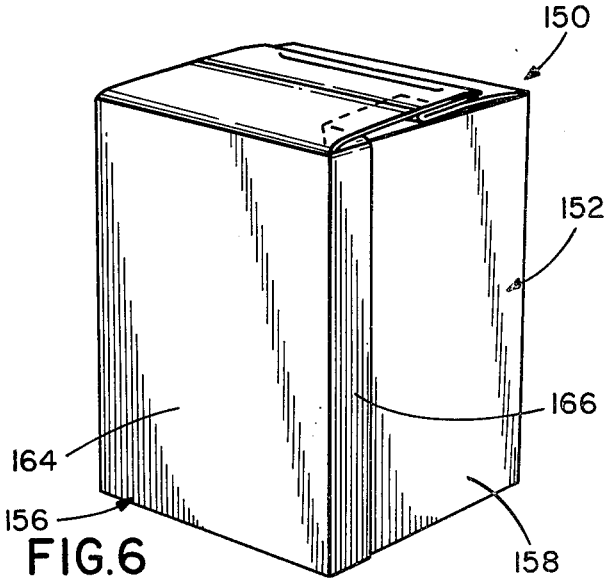
FIG. 6 is a pictorial view of a flat top type container made in accordance with the present invention.
Figure 7:
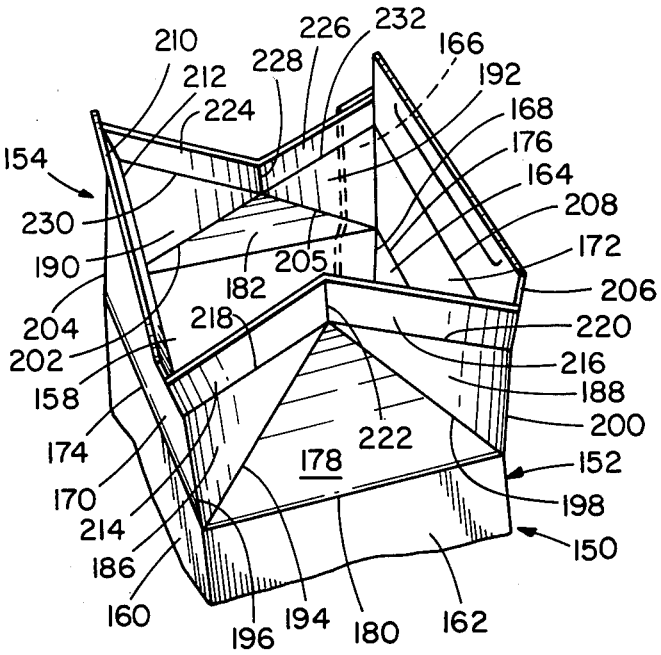
FIG. 7 is a pictorial view of the embodiment of FIG. 6 with the top closure thereof in the open position.
Figure 8:
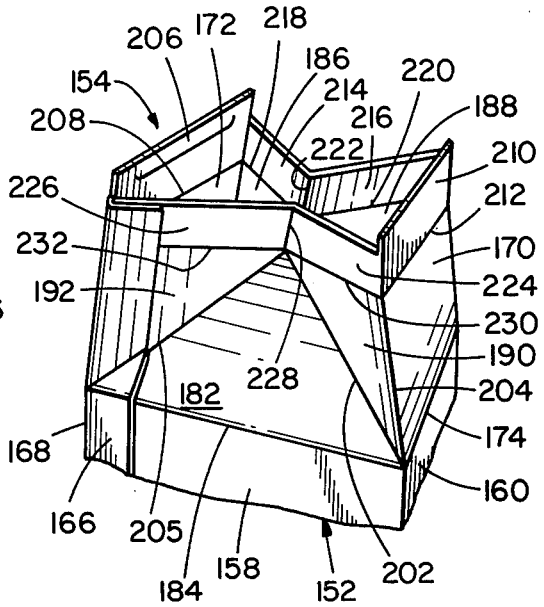
FIG. 8 is a view, similar to FIG. 7, showing the container from the opposite side.

Referring to FIGS. 6–8, the container 150 includes a tubular body section, generally 152, a top closure, generally 154, and a bottom closure, generally 156. The tubular body section 152 includes contiguous, interconnected side walls 158, 160, 162 and 164. A side sealing flap 166 is contiguous with and is connected to the side wall 164 along a score line 168.

The top closure 154 includes a pair of opposed roof panels 170 and 172. The roof panel 170 is interconnected and is contiguous with the side wall 160 along a score line 174. The roof panel 172 is contiguous with and is interconnected to the side wall 164 along a score line 176. A triangular end panel 178 is contiguous with and interconnected to the side wall 162 along a score line 180. An opposite triangular end panel 182 is contiguous with and interconnected to the side wall 158 along a score line 184.

A pair of fold-back panels 186 and 188 are associated with the triangular end panel 178 and a second pair of triangular fold-back panels 190 and 192 are associated with the triangular end panel 182. The fold-back panel 186 is contiguous with and interconnected to the end panel 178 along a score line 194 and is also contiguous with and interconnected to the roof panel 170 along a score line 196. The fold-back panel 188 is contiguous with and interconnected to the triangular end panel 178 along a score line 198 and is contiguous with and interconnected to the roof panel 172 along a score line 200. The fold-back panel 190 is contiguous with and interconnected to the triangular end panel 182 along a score line 202 and is contiguous with and interconnected to the roof panel 170 along a score line 204. The fold-back panel 192 is contiguous with and interconnected to the triangular end panel 182 along a score line 205.

An upper or outer rib panel 206 is contiguous with and interconnected to the roof panel 172 along a score line 208. An opposite panel 210 is contiguous with and interconnected to the roof panel 170 along a score line 212.

One pair of inner rib panels 214 and 216 are associated with the fold-back panels 186,188. The inner rib panel 214 is contiguous with and interconnected with the fold-back panel 186 along a score line 218, while the inner rib panel 216 is associated with the fold-back panel 188 along a score line 220. The inner rib panels 214 and 216 are contiguous with and connected to each other along a vertical score line 222. A second pair of inner rib panels 224 and 226 are associated with the fold-back panels 190 and 192. The inner rib panels 224 and 226 are contiguous with and interconnected to each other along a vertical score line 228. The inner rib panel 224 is contiguous with and interconnected to the fold-back panel 190 along a score line 230 and the inner rib panel 226 is contiguous with and interconnected to the end panel 192 along a score line 232.

Figure 3:
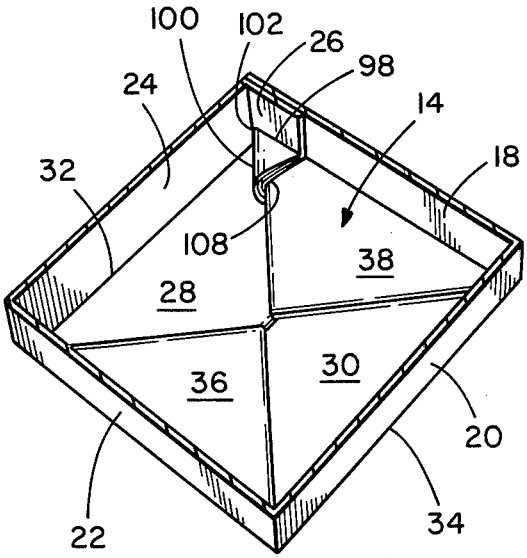
PRIOR ART FIG.3
FIG. 3 is a pictorial sectional view taken along the line 3—3 of FIG. 1, illustrating the interior of the top closure of a prior art, formed flat top end closure container, when inverted.
Figure 9:
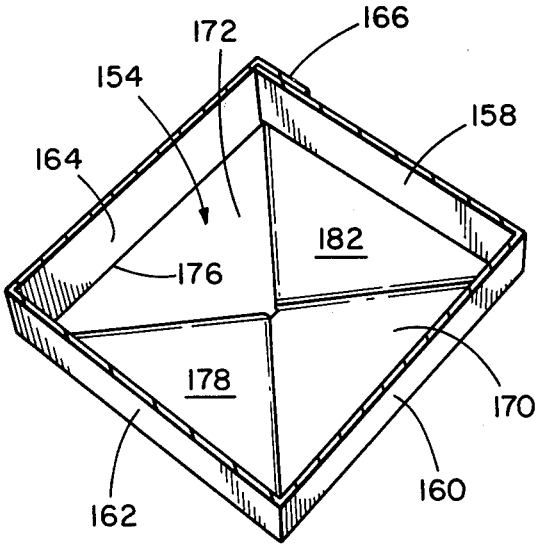
FIG. 9 is a view similar to the prior art embodiment of FIG. 3 showing the interior of the top closure of the inventive embodiment of FIG. 6.

From the foregoing, it is seen that the basic components of the container 150 are similar to the container 10 of the embodiment of FIGS. 1–5. In forming the container 150 into the erected condition, however, it is seen from FIGS. 6–8 that the side sealing flap 166 is secured along a portion of the outer surface of the side wall 158, along a portion of the outer surface of the triangular end panel 182, along a portion of the outer surface of the fold-back panel 192, and along a portion of the outer surface of the inner rib panel 226. The basic improvement found in FIGS. 6–8, as compared to the embodiment of FIGS. 1–5, is apparent when viewing the interior of the top closure section 154 of the container 150, as seen in FIG. 9, and the interior of top closure 154 of the container 10, as seen in FIG. 3. It is seen from FIG. 9 that there is no delamination portion 108 positioned in the interior of the top closure 166. This change has significant, unexpected and synergistic results as the container 150 formed and sealed into the desired condition, the top leakage problem associated with this type of container is avoided, and yet little change is required in forming and scoring the blanks and in erecting and filling the container. Although the placement of a side sealing flap on the exterior of containers has been known (U.S. Pat. Nos. 2,085,979; 2,954,912; 3,081,927; 2,203,614; 3,365,111; 3,495,507; 3,654,842; 2,506,056; and 3,549,080), such construction has not been known with containers of the type shown in FIGS. 1–5.

Figure 10:
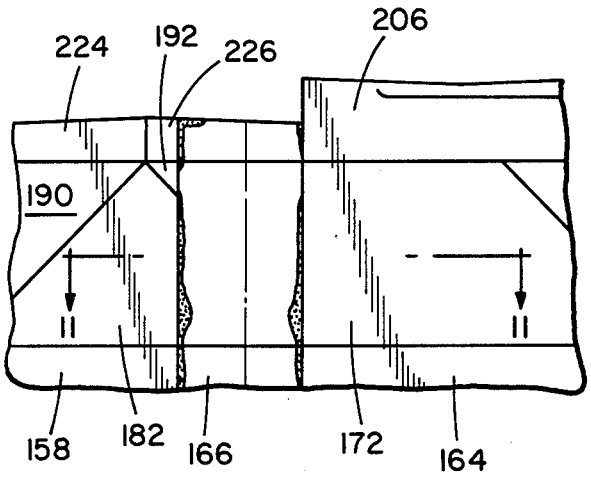
FIG. 10 is a view of the side sealing flap of the present invention in comparison to the prior art shown in FIG. 4.
Figure 11:
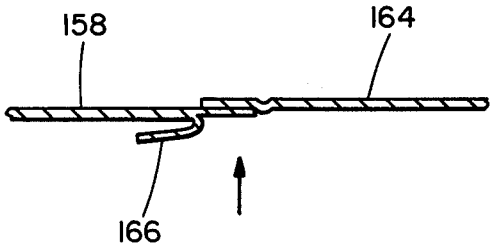
FIG. 11 is a sectional view taken along the line 11—11 of FIG. 10.

Referring to FIGS. 10 and 11, a container 150 was tested for top leakage in the same manner as the prior art container 10, illustrated in FIGS. 4 and 5. A liquid dye material was placed within a container 150 and was subjected to a test to determine top leakage. When the side sealing flap 166 is opened, as seen in FIG. 10, and viewed from the interior side, as indicated by the arrow shown in FIG. 11, the interior of the container shows, in shaded area, the penetration of the dye along the raw edge of the side wall 158 and along the fold-back flap 192 and inner rib panel 226. It is seen that the penetration of the dye is significantly less, and the result is no leakage at the top of the container. Therefore, in a highly simple and economical manner, the top leakage problem found in certain prior liquid containers is avoided.

Figure 12:
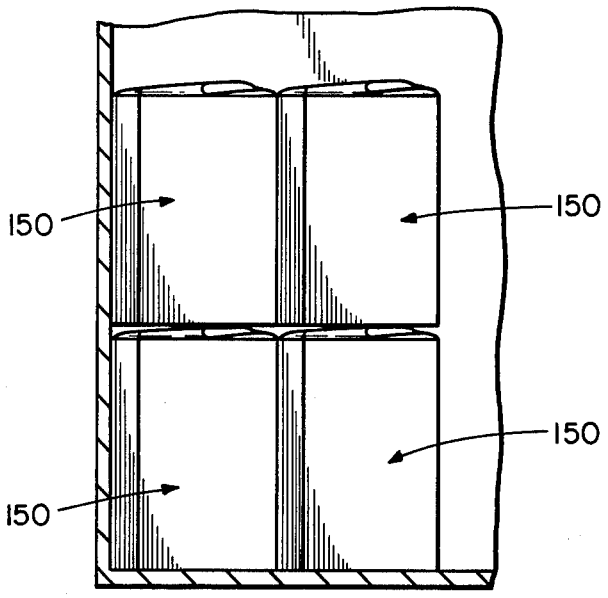
FIG. 12 is a schematic view of the flat top end closure, shown in FIG. 6, as it is stacked within a storage container or display case.

While the advantages of the invention are more fully realized when used with the flat top or slant top type of container, such as shown in FIGS. 6–8, the top leakage problem is also avoided when the gable top type of container is used. In the flat top container, the top closure is brought into closer proximity with the upper surface of the milk or other liquid contained within the container thereby causing the flat top type container to be more susceptible to top leakage problems. As seen in FIG. 12, multiple flat top containers 150 are readily and conveniently stored in a stacked condition in a dairy shipper case or in a refrigerated display case.

Figure 13:
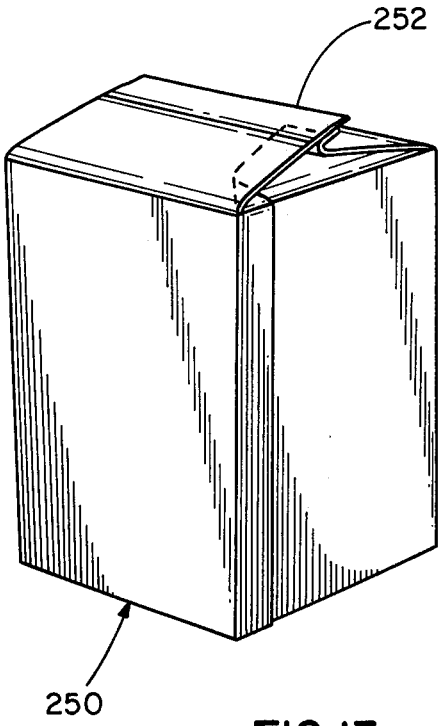
FIG. 13 is a second or alternate embodiment, similar to the embodiment of FIG. 6, except the top closure is a slant top container.
Figure 14:
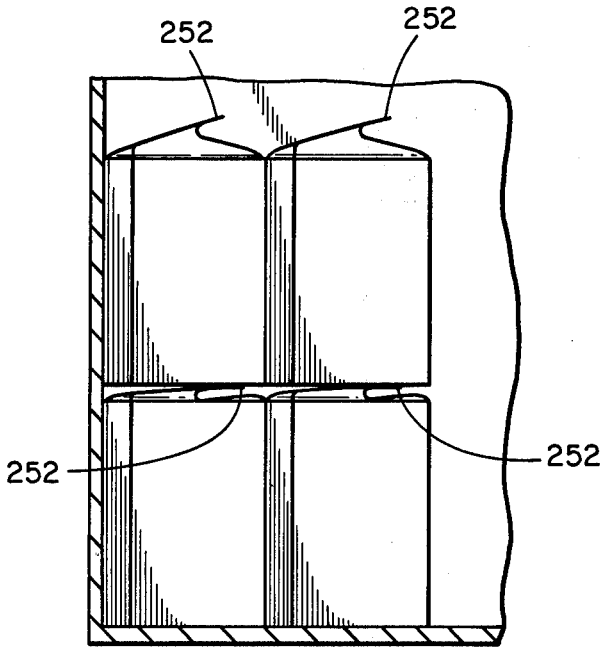
FIG. 14 is a view similar to FIG. 12, except with the embodiment of FIG. 13 being illustrated.

With respect to the slant top type of container, generally 250, as seen in FIGS. 13 and 14, it is considered unnecessary to describe the construction thereof, in detail. Basically, the only difference from the flat top container of FIGS. 6–8 is that the top closure 252 of the container 250 is not secured into the flattened condition as seen in the embodiment illustrated in FIG. 6. Referring to FIG. 14, it is seen that the slant top container 250 may be shipped in a case or stored in a refrigerator case by stacking the containers 250 one on top of the other. Particularly during shipping, there is constant flexure of the top closure 252 of a bottom container because of the weight of the containers 250 stored thereabove. It is believed that this constant flexure aggravates the likelihood of side seam flap delamination and the top leakage problem with slant top containers of the prior art construction.

While in the foregoing, there has been provided a detailed description of particular embodiments of the present invention, it is to be understood that all equivalents obvious to those skilled in the art are to be included within the scope of the invention, as claimed.

What I claim and desire to secure by Letters Patent is:

1. A container of paperboard construction having a coating of thermoplastic material that acts as an adhesive, when heated, to hold the container together, said container comprising, in combination, a tubular body, a top closure for said tubular body, a bottom closure for said tubular body, said tubular body being defined by first, second, third, and fourth contiguous side walls, each of said side walls having an inner surface and an outer surface, a sealing flap contiguous with said fourth side wall and being sealably secured to the outer surface of said first wall for forming said tubular body, said top closure including a pair of opposed roof panels, a pair of triangular end panels folded inwardly between said roof panels, two pairs of triangular fold-back panels, each pair of said fold-back panels being unitary with respect to one of said roof panels, an outer rib panel connected to each of said roof panels, a pair of inner rib panels connected to each of said fold-back panels, a pouring spout stored in a collapsed condition within said container and being defined by one of said triangular end panels, an adjacent pair of said fold-back panels and said inner rib panels, portions of said roof panels and said outer rib panels, each of said roof panels, said triangular end panels, said triangular fold-back panels, said outer rib panels, and said inner rib panels having an inner surface and an outer surface, and said sealing flap also being adhesively secured to the outer surface of portions of the end panel, fold-back panel and inner rib panel located above said first wall to which said sealing flap is adhesively secured.

2. The container of claim 1 wherein said top closure is formable into a flattened condition.

3. The container of claim 2 wherein said container is a slant top container.

4. The container of claim 2 wherein said container is secured in a flat condition.

* * * * *